US011548177B2

(12) United States Patent
Fuellgrabe et al.

(10) Patent No.: US 11,548,177 B2
(45) Date of Patent: Jan. 10, 2023

(54) PERSONAL CARE DEVICE

(71) Applicant: Braun GmbH, Kronberg (DE)

(72) Inventors: Martin Fuellgrabe, Bad Camberg (DE); Stefan Fuerst, Kronberg (DE); Christian Neyer, Eschborn (DE); Johannes Julian Weinkauff, Frankfurt am Main (DE); Lucy Abigail Zimmermann, Kronberg (DE)

(73) Assignee: Braun GMBH, Kronberg (DE)

( * ) Notice: Subject to any disclaimer, the term of this patent is extended or adjusted under 35 U.S.C. 154(b) by 0 days.

(21) Appl. No.: 16/364,731

(22) Filed: Mar. 26, 2019

(65) Prior Publication Data

US 2019/0299436 A1 Oct. 3, 2019

(30) Foreign Application Priority Data

Mar. 27, 2018 (EP) ..... 18164343

(51) Int. Cl.

| | |
|---|---|
| ***B26B 19/38*** | (2006.01) |
| ***B26B 19/04*** | (2006.01) |
| ***B26B 19/10*** | (2006.01) |
| ***B26B 19/28*** | (2006.01) |
| ***B26B 19/40*** | (2006.01) |
| ***B26B 19/46*** | (2006.01) |

(52) U.S. Cl.

CPC ..... *B26B 19/388* (2013.01); *B26B 19/046* (2013.01); *B26B 19/048* (2013.01); *B26B 19/10* (2013.01); *B26B 19/282* (2013.01); *B26B 19/40* (2013.01); *B26B 19/46* (2013.01)

(58) Field of Classification Search

CPC ... B26B 19/388; B26B 19/046; B26B 19/048; B26B 19/10; B26B 19/282; B26B 19/40; B26B 19/46

See application file for complete search history.

(56) References Cited

U.S. PATENT DOCUMENTS

| | | | |
|---|---|---|---|
| 4,531,287 | A | 7/1985 | Shibata et al. |
| 4,930,217 | A | 6/1990 | Wolf et al. |
| 5,007,168 | A | 4/1991 | Messinger et al. |

(Continued)

FOREIGN PATENT DOCUMENTS

| | | | |
|---|---|---|---|
| CN | 1018016 | B | 8/1992 |
| CN | 1688420 | A | 10/2005 |

(Continued)

OTHER PUBLICATIONS

European search report dated Jul. 9, 2018.

(Continued)

*Primary Examiner* — Evan H Macfarlane
*Assistant Examiner* — Liang Dong
(74) *Attorney, Agent, or Firm* — Gerd Zetterer

(57) ABSTRACT

An electric shaver, comprising an elongated handle for manually moving the personal care device along a body surface, a working head attached to said handle for effecting a personal care treatment to said body surface, at least one detector for detecting at least one behavioral parameter indicative of a user's behavior when handling the personal care device, and an adjusting mechanism for adjusting at least one working parameter of the working head in response to the detected behavioral parameter.

13 Claims, 5 Drawing Sheets

(56) References Cited

U.S. PATENT DOCUMENTS

| | | | | |
|---|---|---|---|---|
| 5,189,792 | A | 3/1993 | Otsuka et al. | |
| 5,257,456 | A | 11/1993 | Franke et al. | |
| 5,687,481 | A | 11/1997 | De Boer et al. | |
| 5,745,995 | A | 5/1998 | Yamashita et al. | |
| 6,497,043 | B1 | 12/2002 | Jacobsen | |
| 6,568,083 | B1 | 5/2003 | Taniguchi et al. | |
| 6,826,835 | B1 | 12/2004 | Wong | |
| 7,350,300 | B2 | 4/2008 | Yamaguchi et al. | |
| 7,364,052 | B2 | 4/2008 | Spatafora | |
| 7,832,104 | B2 | 11/2010 | Yamasaki et al. | |
| 8,533,960 | B1 * | 9/2013 | Barish | B26B 19/14 30/43.6 |
| 8,585,411 | B2 | 11/2013 | Puurunen et al. | |
| 8,667,692 | B2 | 3/2014 | Kraus | |
| 8,938,885 | B2 | 1/2015 | Stevens | |
| 10,179,418 | B2 | 1/2019 | Hendriks et al. | |
| 10,576,647 | B2 | 3/2020 | Uit De Bulten et al. | |
| 2001/0025421 | A1 | 10/2001 | Damstra | |
| 2002/0088121 | A1 | 7/2002 | Jacobsen | |
| 2004/0098862 | A1 | 5/2004 | Orloff | |
| 2004/0231160 | A1 | 11/2004 | Shiba et al. | |
| 2005/0216035 | A1 | 9/2005 | Kraus et al. | |
| 2007/0124936 | A1 | 6/2007 | Okabe | |
| 2007/0192174 | A1 | 8/2007 | Bischoff | |
| 2007/0277379 | A1 | 12/2007 | Okabe | |
| 2008/0034591 | A1 | 2/2008 | Fung | |
| 2008/0196258 | A1 | 8/2008 | Kraus | |
| 2009/0000126 | A1 | 1/2009 | Kraus | |
| 2009/0056141 | A1 | 3/2009 | Barry et al. | |
| 2009/0119923 | A1 | 5/2009 | Hart et al. | |
| 2009/0133263 | A1 | 5/2009 | Eichhorn et al. | |
| 2010/0170052 | A1 | 7/2010 | Ortins et al. | |
| 2010/0186234 | A1 | 7/2010 | Binder | |
| 2011/0094102 | A1 | 4/2011 | Guan et al. | |
| 2011/0094107 | A1 | 4/2011 | Ring et al. | |
| 2011/0131812 | A1 | 6/2011 | Erndt et al. | |
| 2011/0197726 | A1 * | 8/2011 | Kraus | B26B 19/048 83/13 |
| 2013/0025078 | A1 | 1/2013 | Heil et al. | |
| 2013/0097873 | A1 | 4/2013 | Luo et al. | |
| 2014/0207811 | A1 | 7/2014 | Kim et al. | |
| 2015/0020658 | A1 | 1/2015 | Hasam | |
| 2015/0032128 | A1 | 1/2015 | Tavlin et al. | |
| 2015/0197016 | A1 | 7/2015 | Krenik | |
| 2016/0001455 | A1 | 1/2016 | Swenson | |
| 2016/0143718 | A1 | 5/2016 | Serval | |
| 2016/0167241 | A1 | 6/2016 | Goldfarb et al. | |
| 2016/0199987 | A1 | 7/2016 | Brada et al. | |
| 2016/0263755 | A1 | 9/2016 | Uit De Bulten et al. | |
| 2017/0043490 | A1 | 2/2017 | Uit De Bulten | |
| 2017/0097758 | A1 | 4/2017 | Bauer et al. | |
| 2017/0099199 | A1 | 4/2017 | Bauer et al. | |
| 2017/0172278 | A1 | 6/2017 | Mehaddene et al. | |
| 2017/0232624 | A1 | 8/2017 | King | |
| 2017/0291319 | A1 | 10/2017 | Hendriks et al. | |
| 2017/0325566 | A1 | 11/2017 | Franklin et al. | |
| 2017/0340085 | A1 | 11/2017 | Kindermann | |
| 2018/0000219 | A1 | 1/2018 | Roenneberg et al. | |
| 2018/0236675 | A1 * | 8/2018 | Westerhof | G06F 3/0482 |
| 2018/0243929 | A1 * | 8/2018 | Takechi | A45D 20/12 |
| 2018/0293511 | A1 | 10/2018 | Bouillet et al. | |
| 2019/0015998 | A1 | 1/2019 | Neyer et al. | |
| 2019/0061183 | A1 | 2/2019 | Neyer et al. | |
| 2019/0090999 | A1 | 3/2019 | Vetter et al. | |
| 2019/0126500 | A1 * | 5/2019 | Wu | B26B 19/388 |
| 2019/0224869 | A1 | 7/2019 | Robinson et al. | |
| 2019/0299432 | A1 | 10/2019 | Fuerst et al. | |
| 2019/0299434 | A1 | 10/2019 | Fuerst et al. | |
| 2019/0299435 | A1 | 10/2019 | Fuellgrabe et al. | |
| 2019/0299437 | A1 | 10/2019 | Fuellgrabe et al. | |
| 2019/0306259 | A1 | 10/2019 | Burghardt et al. | |
| 2020/0156272 | A1 | 5/2020 | De Vries et al. | |
| 2020/0316799 | A1 | 10/2020 | Tsegenidis et al. | |

FOREIGN PATENT DOCUMENTS

| | | | |
|---|---|---|---|
| CN | 101621400 | A | 1/2010 |
| CN | 202106393 | U | 1/2012 |
| CN | 203197960 | U | 9/2013 |
| CN | 104185537 | A | 12/2014 |
| CN | 204431302 | U | 7/2015 |
| CN | 105835093 | A | 8/2016 |
| CN | 105899336 | A | 8/2016 |
| CN | 106407935 | A | 2/2017 |
| CN | 106621280 | A | 5/2017 |
| CN | 106778618 | A | 5/2017 |
| CN | 107073727 | A | 8/2017 |
| CN | 107107351 | A | 8/2017 |
| CN | 107243905 | A | 10/2017 |
| CN | 107414902 | A | 12/2017 |
| CN | 107627329 | A | 1/2018 |
| CN | 107682178 | A | 2/2018 |
| CN | 107718059 | A | 2/2018 |
| CN | 110303526 | A | 10/2019 |
| CN | 110303531 | A | 10/2019 |
| CN | 110303532 | A | 10/2019 |
| CN | 110303533 | A | 10/2019 |
| DE | 10246519 | A1 | 4/2004 |
| DE | 102005045713 | A1 | 3/2007 |
| DE | 102006004675 | A1 | 8/2007 |
| DE | 102008031132 | A3 | 5/2010 |
| DE | 102014001163 | A1 | 8/2015 |
| DE | 102010023681 | B4 | 2/2016 |
| EP | 720523 | B1 | 8/1998 |
| EP | 1165294 | B1 | 6/2003 |
| EP | 1854593 | A1 | 11/2007 |
| EP | 1549468 | B1 | 11/2011 |
| EP | 3197649 | B1 | 5/2018 |
| EP | 3513924 | A1 | 7/2019 |
| EP | 3513925 | A1 | 7/2019 |
| EP | 3546150 | A1 | 10/2019 |
| EP | 3546151 | A1 | 10/2019 |
| EP | 3546152 | A1 | 10/2019 |
| EP | 3546153 | A1 | 10/2019 |
| JP | S5737472 | A | 3/1982 |
| JP | S58-077445 | U | 5/1983 |
| JP | S5877445 | A | 5/1983 |
| JP | 59184778 | U | 12/1984 |
| JP | 04195302 | A | 7/1992 |
| JP | H06-086873 | A | 3/1994 |
| JP | H6335575 | A | 12/1994 |
| JP | 08152902 | A | 6/1996 |
| JP | H08187376 | A | 7/1996 |
| JP | H9-101804 | A | 4/1997 |
| JP | H09101804 | A | 4/1997 |
| JP | 2000507139 | A | 6/2000 |
| JP | 2000508570 | A | 7/2000 |
| JP | 2003-009937 | A | 1/2003 |
| JP | 2004130153 | A | 4/2004 |
| JP | 2006-501911 | A | 1/2006 |
| JP | 2006255335 | A | 9/2006 |
| JP | 2008501911 | A | 1/2008 |
| JP | 2008043426 | A | 2/2008 |
| JP | 2008307132 | A | 12/2008 |
| JP | 2009-508606 | A | 3/2009 |
| JP | 2009-525090 | A | 7/2009 |
| JP | 2010227223 | A | 10/2010 |
| JP | 2010227224 | A | 10/2010 |
| JP | 2010227224 | A * | 10/2010 |
| JP | 2011526168 | A | 10/2011 |
| JP | 2012527939 | A | 11/2012 |
| JP | 201677464 | A | 5/2016 |
| JP | 2016514557 | A | 5/2016 |
| JP | 2016534805 | A | 11/2016 |
| JP | 2017526492 | A | 9/2017 |
| JP | 2017-529168 | A | 10/2017 |
| JP | 2017536948 | A | 12/2017 |
| JP | 2018503420 | A | 2/2018 |
| JP | 2018-532481 | A | 11/2018 |
| JP | 2019171033 | A | 10/2019 |
| JP | 2019171037 | A | 10/2019 |
| JP | 2019171048 | A | 10/2019 |
| JP | 2019171049 | A | 10/2019 |

(56) References Cited

FOREIGN PATENT DOCUMENTS

| | | | |
|---|---|---|---|
| JP | 2019171051 | A | 10/2019 |
| JP | 2019171060 | A | 10/2019 |
| WO | 2001013757 | A1 | 3/2001 |
| WO | 02083257 | A2 | 10/2002 |
| WO | 2007033729 | A1 | 3/2007 |
| WO | 2014091719 | A1 | 6/2014 |
| WO | 2015067489 | A1 | 5/2015 |
| WO | 2015067498 | A1 | 5/2015 |
| WO | 2016094327 | A1 | 6/2016 |
| WO | 2016096581 | A1 | 6/2016 |
| WO | 2016180929 | A1 | 11/2016 |
| WO | 2017032547 | A1 | 3/2017 |
| WO | 2017062326 | A1 | 4/2017 |
| WO | 2017157411 | A1 | 9/2017 |
| WO | 2018002755 | A1 | 1/2018 |
| WO | 2018037318 | A1 | 3/2018 |

OTHER PUBLICATIONS

European Opinion and Search Report; EP Application No. 18164341; dated Jul. 11, 2018; European Patent Office; Munich, Germany.
European Opinion and Search Report; EP Application No. 18164344; dated Dec. 14, 2018; European Patent Office; Munich, Germany.
European Opinion and Search Report; EP Application No. 18164369; dated Jul. 16, 2018; European Patent Office; Munich, Germany.
Japan Search Report; Japan Application No. 2019044483; dated Apr. 23, 2020; Japan Patent Office; Tokyo, Japan.
Notice of Refusal; Japan Application No. 2019044483; dated Jun. 2, 2020; Japan Patent Office; Tokyo, Japan.
Notice of Refusal; Japan Application No. 2019056991; dated Apr. 28, 2020; Japan Patent Office; Tokyo, Japan.
Davies, Samuel Allen; Restriction/Election Requirement; U.S. Appl. No. 16/364,713; dated Jun. 19, 2020; U.S. Patent and Trademark Office; Alexandria, Virginia.
Patel, Bharat C.; Restriction/Election Requirement; U.S. Appl. No. 16/364,739; dated May 27, 2020; U.S. Patent and Trademark Office; Alexandria, Virginia.
Tanushri Chakravorty; "How Machine Learning Works: An Overview"; Oct. 28, 2016; obtained from https://thenewstack.io/how-machine-learning-works-an-overview; accessed Oct. 5, 2020.
Sofiane Boukhalfa; "IoT and AI Combine to Dominate Consumer Electronics", May 2017, obtained from https://www.prescouter.com/2017/05/iot-ai-consumer-electronics/; accessed Oct. 5, 2020.
Jacques Smuts; "Tutorial on Filters in Control Systems"; Nov. 29, 2016; obtained from https://blog.opticontrols.com/archives/1319; accessed Oct. 5, 2020.
Bermudez-Chacon et al.; "Automatic problem-specific hyperparameter optimization and model selection for supervised machine learning: Technical Report"; 2015, obtained from https://www.research-collection.ethz.ch/bitstream/handle/20.500.11850/107673/eth-48308-01.pdf; accessed Oct. 5, 2020.
Search Report; Chinese Application No. 2019102349467; dated Aug. 26, 2020; Chinese National Intellectual Property Administration; Beijing, China.
Search Report by registered search authority Techno Search, Inc.; Japan Application No. 2019-052818; dated Jun. 17, 2020; Japanese Patent Office; Tokyo, Japan.
Search Report; Chinese Application No. 2019102349433; dated Aug. 17, 2020; Chinese National Intellectual Property Administration; Beijing, China.
Search Report; Chinese Application No. 2019102249740; dated Aug. 31, 2020; Chinese National Intellectual Property Administration; Beijing, China.
Search Report by registered search authority Techno Search, Inc.; Japan Application No. 2019-053167; dated Jun. 16, 2020; Japanese Patent Office; Tokyo, Japan.
Search Report; Chinese Application No. 2019102309169; dated Jun. 20, 2020; Chinese National Intellectual Property Administration; Beijing, China.
Nunziante Calabrese; Extended European Search Report; European Patent Application No. 18164337.0; dated Jul. 18, 2018; EPO; Munich, Germany.
Nunziante Calabrese; Extended European Search Report; European Patent Application No. 18164335.4 9; dated Jul. 18, 2018; EPO; Munich, Germany.
Japanese Search by Registered Search Authority Industrial Property Cooperation Center; Japanese Patent Application No. 2019-052815; dated Jul. 17, 2020; Japanese Patent Office; Tokyo, Japan.
Japanese Search by Registered Search Authority AIRI; Japanese Patent Application No. 2019-047272; dated Apr. 16, 2020; Japanese Patent Office; Tokyo, Japan.
Chinese Search Report; Chinese Application No. 2019102349429; dated Aug. 8, 2020; CNIPA; Beijing, China.
Chinese Search Report; Chinese Application No. 2019102297388; dated Jun. 18, 2020; CNIPA; Beijing, China.
All Office Actions, U.S. Appl. No. 16/364,739.
All Office Actions, U.S. Appl. No. 16/364,753.
All Office Actions, U.S. Appl. No. 16/364,682.
All Office Actions, U.S. Appl. No. 16/364,699.
All Office Actions, U.S. Appl. No. 16/364,713.
Lewis et al., Reinforcement Learning and Optimal Adaptive Control, Oct. 2011, Chapter 11, pp. 461-517 (Year: 2011).

* cited by examiner

PERSONAL CARE DEVICE

FIELD OF THE INVENTION

The present invention relates to a personal care device, in particular skin treatment device such as electric shaver, comprising an elongated handle for manually moving the personal care device along a body surface, a working head attached to said handle for effecting a personal care treatment to said body surface, at least one detector for detecting at least one user's behavior parameter characterizing the user's behavior during the personal care treatment, and an adjusting mechanism for adjusting at least one working parameter of the working head in response to the detected behavioral parameter. More particularly, such personal care device may be a hair removing device such as an epilator or a shaver, wherein such shaver may be an electric shaver comprising at least one cutter unit and, a drive unit for driving said at least one cutter unit. Furthermore, the invention also relates to a method of controlling such personal care device.

BACKGROUND OF THE INVENTION

Electric shavers usually have one or more cutter elements driven by an electric drive unit in an oscillating manner where the cutter elements reciprocate under a shear foil, wherein such cutter elements or undercutters may have an elongated shape and may reciprocate along their longitudinal axis. Other types of electric shavers use rotatory cutter elements which may be driven in an oscillating or a continuous manner. Said electric drive unit may include an electric motor or an electric-type linear motor, wherein the drive unit may include a drive train having elements such as an elongated drive transmitter for transmitting the driving motion of the motor to the cutter element, wherein the motor may be received within the handle portion of the shaver or in the alternative, in the shaver head thereof.

Although such shavers are used on a daily basis by most users, it is sometimes difficult to operate and handle the shaver indeed perfectly. Due to different preferences and habits of different users, often the shaver is not operated in its optimum range. For example, the working head with the cutter elements may be pressed against the skin too strongly, or the shaver may be held at an orientation preventing the working head's shear foils from full contact with the skin, even if the working head is pivotably supported to compensate for some angular displacement. Sometimes it is also difficult to move the shaver along the skin at the right velocity in the right direction to the relevant skin portions. So as to make handling easier and more intuitive, the shaver may provide for various different operating modes and adjustment functions, wherein, however, it is sometimes difficult for a user to find the appropriate setting.

For example, a shaver's drive units are sometimes operable in different operation modes, wherein for example the cutter speed or oscillation frequency may be varied to increase shaving efficiency in a fast mode or highspeed mode, or in the alternative, to avoid skin irritation in a sensitive mode. Depending on the fittings of the shaver, other operation modes may be offered and may include a long-hair cutting mode, wherein a long-hair cutter may be activated and/or moved into a projecting position to allow easier cutting of long hairs.

In addition to such options for different operation modes, personal care devices such as shavers also include self-adjustment functions. For example, it is well known in the field of shavers to moveably suspend the shaver head to allow the cutter elements to self-adjust their position and orientation to better follow the skin contour. More particularly, the shaver head may be pivotably supported to pivot about one or two pivot axes extending transverse to the longitudinal axis of the handle so the working surface of the shaver head may stay in full contact to the skin contour even when the handle is held at a "wrong" orientation. Furthermore, the cutter elements may dive into the shaver head structure so as to compensate for excessive forces pressing the shaver head against the skin.

However, despite such various self-adjustment functions, there is still the problem that one product design must fit all users what is hardly possible. People behave in very different ways and have unique needs such as different types of hair growth when shaving and thus, no single product design can perfectly fit all users.

If the adjustment needs to be made by the user, then this has multiple disadvantages. Firstly, this is inconvenient, which results in the adjustment often not being used. Secondly, it is very often not clear to the user what adjustment is needed to best achieve what he is trying to achieve. A typical example can be illustrated by a common problem: individual missed hairs that are often left uncut during the standard shaving routine. The user then tries in different ways after the rest of the shave to shave these individual hairs. A typical behavior is repeated short strokes over the area with increasing pressure on the cutting elements, whereas decreasing, not increasing, the pressure would be beneficial for this situation.

Alternatively, the adjustment can be automatic. However, existing devices that attempt this, do not deliver an optimal result. Two typical reasons have emerged for the poor performance: On the one hand, when the adjustment is pre-determined, this does not work for all users. For example, the level of shave pressure that leads to skin irritation varies between users and can vary for the same user between days. A shaver that reacts in a pre-determined way to a certain level of shave pressure in order to avoid skin irritation will react too early for some users and too late for others. On the other hand, the high complexity of a shave makes it difficult to find the optimum setting of the adjustable components. More particularly, the quality of the overall shave result and experience depends on the summation of many different interacting shaving parameters, e.g. closeness, skin comfort, time of shave, gliding, skin experience, feeling of control, accuracy of beard contours, etc. These shaving parameters are in turn influenced by the combination of multiple parameters, which again have their own complex interactions.

Document EP 0 720 523 B1 discloses an electric shaving apparatus which allows for adjusting the height over which the cutter elements project from the shaver head surface, adjusting the pretensioning force of the cutter blades against which pretensioning force the cutter blades may dive, and adjusting the motor speed so as to balance shaving performance and skin irritation. Said adjustable parameters, i.e. cutter height, pretensioning force and motor speed, are automatically controlled in response to a plurality of detected working parameters including measured skin contact force and an acoustic signal measured by a microphone which signal is assumed to indicate a number of hairs cut by the cutter. Although the control uses fuzzy logic to balance the influence of the different input signals indicative of the different working parameters, the achieved self-adjustment of the shaver is still insufficient in terms of fitting different user's needs and different user's preferences.

Furthermore, WO 2007/033729 A1 discloses an electric hair removal device adjusting the motor speed and thus cutter speed in response to the velocity at which the hair removal device is moved along the user's skin which velocity is measured by means of a rotational sensor. The shaver includes a memory in which velocity detected in the past is stored so as to start a hair removal session with a motor speed in line with the stored velocity detected in the past.

Document WO 2015/067498 A1 discloses a hair cutting device, wherein a position identifier including cameras identifies the position of the hair cutter relative to the body part to be treated, wherein a feedback module gives feedback to indicate the desired path and the desired angle of orientation of the cutter relative to the body part.

Furthermore, document WO 2017/062326 A1 describes a personal care device linked to a smartphone and a computer system via a network so as to monitor device usage. More particularly, working time is monitored to indicate when a replacement part such as a razor cartridge needs to be replaced, wherein determination of working time includes adjustment of the sensor settings such as the minimum duration for counting a shaver stroke.

Furthermore, document WO 2017/032547 A1 discloses a shaving device giving a user shaving instructions acoustically and/or visually, wherein such shaving instructions such as "user gentle pressure only" or "use sensitive speed setting" are given based on usage data such as pressure data and/or motion data measured by the shaving device. It is also suggested to take into account usage data history to select the appropriate instruction from a stored list of instructions.

EP 1549468 B1 describes a shaver which detects proper contact of the shear foils with the skin to be shaved, wherein it is mentioned that such contact may be detected by means of an inductive sensor, a capacitance sensor or an optical sensor which may include a light barrier immediately above the shear foil. It is suggested to automatically vary the position of the shaver head relative to the handle by means of an actuator for pivoting or tilting the shaver head, when there is improper contact to the skin.

SUMMARY OF THE INVENTION

It is an objective underlying the present invention to provide for an improved personal care device avoiding at least one of the disadvantages of the prior art and/or further developing the existing solutions. A more particular objective underlying the invention is to provide for an improved self-adjustment of the personal care device to the user.

A further objective underlying the invention is to provide for an improved personal care device automatically modifying at least one of its adjustment functions so that less adaption from the user to the product is necessary.

A still further objective underlying the invention is to provide for an improved method of controlling a personal care device to achieve better self-adjusting to different behavior and preferences of different users.

To achieve at least one of the aforementioned objectives, it is suggested to adapt the adjustment mechanism of the personal care device to the value and/or quality of the detected behavioral parameter so as to adapt the adjustment function to the individual behavior of the user. More particularly, the personal care device includes a calibration device for calibrating the relation between the adjustment of the at least one working parameter by the adjusting mechanism to the detected behavioral parameter in response to the historical data of the detected behavioral and/or another parameter as well as current values thereof. The calibration device may include a microprocessor which runs an algorithm as set forth hereinbelow. Said microprocessor is provided on a PCB inside the handle of the personal care device. Alternatively, the algorithm may be provided in an external device as e.g. a smartphone or cloud server. When, for example, a certain detected behavioral parameter changes within a certain range during a current treatment session and/or has changed within a certain range during past-treatment session, the adjustment mechanism may be calibrated to consider a current value of the behavioral parameter at an upper limit of the aforementioned, determined range or above said range to be at a high level and/or a current value in the middle of said range to be an average level value and/or a current value at a lower limit of said range or even below said lower limit to be a low-level value of said behavioral parameter. Due to such calibration, the adjustment mechanism may adjust the working parameter in a way fitting better the individual user's needs.

For example, when a skin contact pressure is detected as behavioral parameter, a first user may handle the personal care device with a skin contact pressure ranging from 2 to 4 N so, by means of the aforementioned calibration device, the adjustment mechanism may learn to consider 2 N to be a low pressure for this user, whereas 4 N would be a high pressure. On the other hand, when another user handles the personal care device with a skin contact pressure ranging from 1 to 2 N the adjustment mechanism would learn 2 N is a high pressure, whereas 1 N is a low pressure. Depending on the type of adjustment and/or depending on the working parameter, the adjustment mechanism may set the working parameter to a high level, when the detected behavioral parameter reaches 4 N for the first user, and to a low level when the skin contact pressure reaches 2 N for said first user, whereas the working parameter could be set to a high-level setting when 2 N are detected for a second user.

The historical data used by the calibration device for calibrating the adjustment device, however, do not have to be historical data of the same behavioral parameter on the basis of which the adjustment device adjusts the at least one working parameter of the personal care device, but the calibration device may consider other parameters and the historical data thereof to calibrate the adjustment device. For example, in addition or in the alternative to the aforementioned history of the skin contact pressure the calibration device may take into account historical data of an air humidity sensor or another environmental sensor. Based on a change in air humidity, for example, 2 N skin contact pressure might be considered low pressure for a particular user in a dry room, whereas in a damp room for example after a shower 2 N skin contact pressure might now be considered to be high pressure for said particular user.

Furthermore, the historical data used by the calibration device for calibrating the adjustment device may be data continuously or repeatedly detected during each regular personal treatment session. In addition or in the alternative to historical data detected continuously or repeatedly during each regular personal treatment session, the calibration device may take into account historical data coming from a database of multiple users in which database historical data of the aforementioned behavioral parameter and/or another parameter detected during personal treatment sessions of multiple users were stored. Use of such historical database may enlarge the basis for calibration.

According to another aspect of the invention, the personal care device may have a pivotable suspension of its working head to allow for pivoting of the working head or part of the working head relative to the handle about at least one axis, wherein the adjustment mechanism is configured to adjust the pivoting stiffness of the working head's suspension and/or the resistance and/or unwillingness of the working head against pivoting movements so as to give the personal care device a more aggressive, performance-oriented handling on the one hand and a more comfortable, smoother handling on the other hand, depending on the user's behavior. More particularly, the adjustment mechanism may vary the torque and/or force necessary to pivot the working head relative to the handle and/or to achieve a certain pivot angle of the working head deviating from a neutral or otherwise predetermined default position relative to the handle thereof.

In addition or in the alternative, the adjustment mechanism may be configured to adjust the angular pivoting range of the working head to allow a larger or smaller maximum angular displacement. The personal care device will give a more aggressive, performance-oriented feeling to the user when the maximum available pivoting angle is smaller, whereas a more comfortable, smoother feeling is provided with a larger maximum pivoting angle.

Such adjustment of the pivoting stiffness and/or the angular pivoting range of the working head may be automatically controlled in response to at least one behavioral parameter selected from the group of parameters comprising skin contact pressure of one or more working elements or the entire working head, velocity at which the personal care device is moved along a body portion to be treated, frequency of strokes, angular orientation of the personal care device relative to the gravitational field and position of fingers gripping the handle and position of the working head relative to the body to be treated. For example, pivoting stiffness of the working head may be adjusted in response to skin pressure with which the working head is pressed against the skin of a user, wherein such skin pressure can be detected by a suitable skin pressure sensor. When a user of a shaver, for example, encounters difficulties in getting longer hairs cut, the user usually presses the shaver head stronger against the skin, wherein the user may get the impression that the shaver head pivots too easily. Thus, when detecting an increased skin pressure, the adjustment mechanism may increase the pivoting stiffness.

In addition or in the alternative, when a user moves the personal care device at high velocities over the body portion to be treated and/or at a high stroke frequency, the user may need quicker pivoting of the working head and thus less pivoting stiffness so the adjustment mechanism may increase pivoting stiffness in response to an increase in velocity and/or stroke frequency as detected by a corresponding sensor.

In addition or in the alternative, the adjustment mechanism may increase pivoting stiffness when a change of the finger grip position on the handle is detected and/or a change of the angular orientation of the handle and/or angular rotation of the handle is detected what indicates the user is adapting to the device, when, for example, a user is shaving a neck portion. Typically, when shaving the neck area, a user will rotate the shaver around the longitudinal axis of the handle and change the finger grip position such that the shaver's front side points away from the user. Additionally, the user then rotates the shaver around an axis parallel to the swivel axis of the shaver head. Based on detection of such behavioral parameters, the adjustment mechanism may increase the pivoting stiffness and or reduce the pivoting range.

These and other advantages become more apparent from the following description giving reference to the drawings and possible examples.

DETAILED DESCRIPTION OF THE INVENTION

Figure 1:
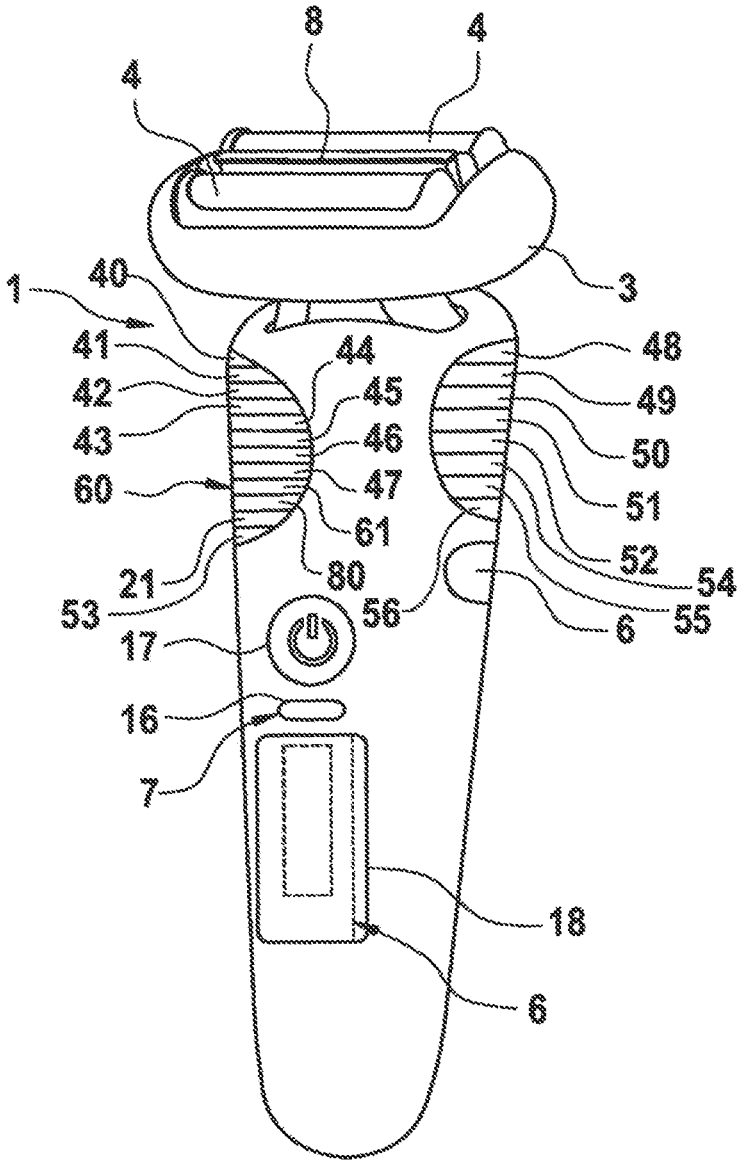
FIG. 1: a perspective view of a personal care device in terms of an electric shaver comprising a handle and a shaver head pivotably connected thereto, wherein pivoting stiffness of the shaver head and diving or floating resistance of the cutter elements may be adjusted in response to user behavior.

The personal care device offers comfortable ways of self-adapting to different preferences and behavior of different users.

According to an aspect, so as to allow for rendering substantially the full range of adjusting the device to users having different operating habits, the personal care device is provided with a calibration device. More particularly, the personal care device includes a calibration device for calibrating the relation between the detected behavioral parameter/s and the at least one adjustment signal for adjusting the working parameter in response to historical data of the detected behavioral parameter and/or another parameter detected during a current and/or previous treatment sessions.

More particularly, the calibration device may be configured to calibrate the relation between the adjustment of at least one working parameter by the adjusting mechanism to the detected behavioral parameter in response to the history of the detected behavioral parameter as well as current values thereof. When for example a certain detected behavioral parameter changes within a certain range during a current treatment session and/or has changed within a certain range during past-treatment session, the adjustment mechanism may be calibrated to consider a current value of the behavioral parameter at an upper limit of the aforementioned, determined range or above said range to be at a high level and/or a current value in the middle of said range to be an average level value and/or a current value at a lower limit of said range or even below said lower limit to be a low-level value of said behavioral parameter. Due to such calibration, the adjustment mechanism may adjust the working parameter in a way fitting better the individual user's needs.

When detection of behavioral parameters includes, for example, detection of a force with which the working head is pressed against the body surface to be treated and the adjustment includes adjusting the pivoting stiffness to low, average and high stiffness, the controller for controlling the pivoting stiffness may be calibrated to issue a stiffness setting signal indicative of average stiffness when the detected force corresponds to an average value range of the detected forces of the user history, and/or low stiffness when the detected force corresponds to a low value range of the detected forces of the user history, and/or high stiffness when the detected force corresponds to a high value range of the detected forces of the user history.

Contrary to for example fuzzy logic, the calibration device may change or reset the calculation rule or set of calculation rules so, after calibration, the same behavioral input signals do no longer result in the same actuation of the adjustment actuator. Fuzzy logic models used in the prior art may provide for different output calculation functions for different subranges of a continuous variable and may provide for multiple membership function to determine the output depending on membership of an input to a certain subrange or membership of a plurality of inputs to a certain combination of subranges. However, for a given combination of input signals having given values, the rule of calculation of the output is predetermined and is not modified so the output of the fuzzy logic is always the same for such given combination of input signals. In contrast, the calibration of the personal care device described herein indeed modifies the calculation rule so the output control signal may become different although the behavioral input signal to which the calibration is applied is the same.

For example, when a skin contact pressure is detected as behavioral parameter, a first user may handle the personal care device with a skin contact pressure ranging from 2 to 4 N so, by means of the aforementioned calibration device, the adjustment mechanism may learn to consider 2 N to be a low pressure for this user, whereas 4 N would be a high pressure. On the other hand, when another user handles the personal care device with a skin contact pressure ranging from 1 to 2 N the adjustment mechanism would learn 2 N is a high pressure, whereas 1 N is a low pressure. Depending on the type of adjustment and/or depending on the working parameter, the adjustment mechanism may set the working parameter to a high level, when the detected behavioral parameter reaches 4 N for the first user, and to a low level when the skin contact pressure reaches 2 N for said first user, whereas the working parameter could be set to a high-level setting when 2 N are detected for a second user.

A further specific example of when the calibration might be carried out is when it is recognized that the device is being used by a different user e.g. by detecting very different behavioral to usual. In this case, the calibration device may recalibrate the adjustment device back to the default/factory setting assuming that it has already modified the setting for the first user.

The calibration device may include an adaptive controller for adaptively controlling the adjustment device in response to the at least one detected behavioral parameter to provide for different self-adjustments for different behavioral parameters within the range of the values of the detected behavioral parameter of the user history thereof.

The working parameters which may be adjusted by the adjustment mechanism, may comprise different physical settings and/or functions of the device affecting the personal care treatment, such as a mechanical setting or mechanical function of the working head and/or of the working tool and/or of a drive unit or drive train of the device. More particularly, a working parameter changing the way the personal care treatment is applied, can be adjusted. Such mechanical settings or functions may include the movability of the working head relative to the handle and/or the operation of one or more working tools such as a long-hair cutter and the positions thereof relative to other tools, and/or the temperature of a cooling/heating element for cooling/heating the skin, and/or the operation of a lubricant applicator for applying a lubricant to the body portion to be treated. Such working parameters which are adapted, may be characteristic of functional properties of the personal care device and may include at least one of the following: height of different cutting elements and/or non-cutting elements, e.g. guard, combs, etc., relative to each other, blade frequency, blade amplitude, floating force of individual cutting elements, force needed to swivel/tilt head, ratio between area of cutting parts to area of non-cutting parts in terms of e.g. head frame in contact with user's skin, skin tensioning elements, 3D angle of head relative to body, height of head relative to body, foil hole size and/or pattern, shaver head vibrations, handle vibrations.

According to another aspect of the invention, the personal care device may have a pivotable suspension of its working head to allow for pivoting of the working head relative to the handle about at least one axis, wherein the adjustment mechanism is configured to adjust the pivoting stiffness of the working head's suspension and/or the resistance and/or unwillingness of the working head against pivoting movements so as to give the personal care device a more aggressive, performance-oriented handling on the one hand and a more comfortable, smoother handling on the other hand, depending on the user's behavior. More particularly, the adjustment mechanism may vary the torque and/or force necessary to pivot the working head relative to the handle and/or to achieve a certain pivot angle of the working head deviating from a neutral position thereof.

In addition or in the alternative, the adjustment mechanism may be configured to adjust the angular pivoting range of the working head to allow a larger or smaller maximum angular displacement. The personal care device will give a more aggressive, performance-oriented feeling to the user when the maximum available pivoting angle is smaller, whereas a more comfortable, smoother feeling is provided with a larger maximum pivoting angle.

Such adjustment of the pivoting stiffness and/or the angular pivoting range of the working head may be automatically controlled in response to at least one behavioral parameter selected from the group of parameters comprising skin contact pressure, velocity at which the personal care device is moved along a body portion to be treated, frequency of strokes, angular orientation of the personal care device relative to the gravitational field and position of fingers gripping the handle and position of the working head relative to the body to be treated. For example, pivoting stiffness of the working head may be adjusted in response to skin pressure with which the working head is pressed against the skin of a user, wherein such skin pressure can be detected by a suitable skin pressure sensor. When a user of a shaver, for example, encounters difficulties in getting longer hairs cut, the user usually presses the shaver head stronger against the skin, wherein the user may get the impression that the shaver head pivots too easily. Thus, when detecting an increased skin pressure, the adjustment mechanism may increase the pivoting stiffness.

In addition or in the alternative, when a user moves the personal care device at high velocities over the body portion to be treated and/or at a high stroke frequency, the user may need quicker pivoting of the working head and thus less pivoting stiffness so the adjustment mechanism may increase pivoting stiffness in response to an increase in velocity and/or stroke frequency as detected by a corresponding sensor.

In addition or in the alternative, the adjustment mechanism may increase or decrease pivoting stiffness when a change of the finger grip position on the handle is detected and/or a change of the angular orientation of the handle and/or angular rotation of the handle is detected what indicates the user is adapting to the device, when, for example, a user is shaving a neck portion. Typically, when shaving the neck area, a user will rotate the shaver around the longitudinal axis of the handle and change the finger grip position such that the shaver's front side points away from the user. Additionally, the user then rotates the shaver around an axis parallel to the swivel axis of the shaver head. Based on detection of such behavioral parameters, the adjustment mechanism may increase the pivoting stiffness and or reduce the pivoting range.

In addition or in the alternative, pivoting stiffness may be adjusted in response to other parameters such as environmental parameters. For example, at least one environmental detector may detect air humidity and/or air temperature, wherein the pivoting stiffness may be adjusted in response to detected air humidity and/or air temperature.

In the alternative or in addition, the pivoting stiffness may be adjusted in response to a physiological parameter of the user which may be detected by a suitable physiological detector. For example, density and/or length of hairs on a skin portion to be shaved may be detected by a visual or optical sensor such as a camera. Furthermore, skin moisture or skin oiliness may be detected to adjust one of the aforementioned working parameters such as pivoting stiffness.

In addition to sensor data detected during normal use of the shaver, other pieces of information may be used to adapt the self-adjustment function of the personal care device to a user's preferences. For example, a database of one or more known user adaptions may be used to identify when the particular user is adapting his behavior to the shaver, optionally also including typical adaptions for known physiological and/or climatic conditions, wherein such data base may be based on large-scale consumer research and/or may receive updates during the lifetime of the product. The control unit of the personal care device may compare the individually detected parameters to data from the database to find out if the detected data indicates normal, average behavior and/or normal/average parameters and/or represent an adaptive behavior.

In addition or in the alternative to such reference data from a database, adjustment of the personal care device also may be achieved on the basis of data collected from the user himself/herself. For example, the device may include input means such as a touchscreen to input a user's preferences.

A display device may include at least one display field which is used for displaying information relative to setting choices as well as information relative to other aspects of the shaver such as the aforementioned charging level, shaving time, cleaning status or wear and tear status. For example, such display field may be configured to display pictograms such as a cascade or row of display points in terms of for example a row of LEDs or a single LED.

In addition to or in the alternative to visually displaying such relevant information, there may be other means of communication to communicate such information to a user. For example, audio output means may output audible signals such as speech to communication the information to the user.

In addition or in the alternative to a display or other information output provided on the electric shaver itself, a display such as a touch display and/or other communication means may be provided on a cleaning and/or loading station configured to receive and/or be connected to the electric shaver so as to charge the shaver's battery and/or clean the shaver, wherein a fluid may be applied to the shaver head to clean the shaver. Such cleaning and/or charging station may include a display device and/or an audio output device or another communicator configured to communicate with the electric shaver at least when the shaver is docked into the station so as to display and/or input the aforementioned information. Such communication means provided on the personal care device itself and/or an auxiliary station thereof, also may be configured to allow for inputting of an override function to enable the user to set and/or modify and/or use a different device functional property from that determined by the calibration device. In addition or in the alternative, the communication means may be configured to allow a user for selecting different operation modes. For example, a sport mode or a comfort mode may be chosen so as to influence how quickly the self-modifications take place.

In addition or in the alternative a startup mode may be provided every time the device is touched and/or powered on as a functional signal to the user to welcome same or to indicate its abilities or its readiness. This functional signal may be e.g. a motorized swivel of the shaver head from a first position into a second position, a motor sound, a light or display signal.

These and other features become more apparent from the example showing in the drawings. As can be seen from FIG. 1, the shaver 1 may have a shaver housing forming a handle 2 for holding the shaver, which handle may have different shapes such as—roughly speaking—a substantially cylindrical shape or box shape or bone shape allowing for economically grabbing the shaver.

On one end of the shaver 1, a shaver head 3 is attached to the handle, wherein the shaver head 3 may be slewably supported about one or more slewing axes.

The shaver head 3 includes at least one cutter unit 4 which may include a cutter element or undercutter reciprocating under a shear foil. The shaver head 3 may also include a long hair cutter 8 as it is shown by FIG. 1.

So as to drive such cutter unit 4 and the long hair cutter 8, a drive unit 5 may include a motor that can be received within the handle 2 and can be connected to the cutter unit 4 and the long hair cutter 8 by means of a transmitter or drive train extending from the motor to the cutter unit.

As can be seen from FIG. 1, an ON-OFF switch or power switch 17 may be arranged at the handle 2. By means of such power switch 17, the drive unit 5 may be started and switched off again.

As can be seen from FIG. 1, the shaver 1 further includes a display 18 which may be provided on the handle 2, for example on a front side thereof. Such display 18 may be a touch display device allowing individual setting preferences to be input.

As can be seen from FIG. 1, the shaver 1 may include further input elements 7 in terms of, for example, a touch button 16 which may be positioned in the neighborhood of the power switch 17.

Several working parameters and/or working functions of the shaver 1 can be adjusted by means of an adjustment device 6 which may change mechanical settings and/or operational settings of the shaver such as the pivoting stiffness of the shaver head 3 and the position and/or operation of the long-hair cutter 8 as will be described in detail. Such adjustment device 6 may include one or more adjustment actuators such as electric motors or electric actors or actors of other types using other forms of energy such as magnetic actors. Such adjustment actuators may be controlled by a control unit 80, wherein such control unit 80 may include an electronic control unit, in particular a micro-controller working on the basis of software stored in a memory.

Such control unit 80 may take into account different treatment parameters which are detected during operation of the shaver 1 by a plurality of detectors. In addition, the control unit 80 also may be responsive to a history of the values of detected parameters of the current shaving session and/or a previous shaving session, as will be described in greater detail.

Such detectors may include in particular a force detector 41 for detecting the force with which the working head 3 is pressed onto the body surface 30. Such force detector 41 may include various sensing means such as a sensor measuring diving of the working head 3 towards the handle 2, a sensor measuring bending stresses in the handle or a sensor measuring torque and/or load of a motor driving the working tools which are all representative of contact pressure.

In response to detected pressure or force with which the working head is pressed against the skin, the control unit 80 may vary the pivot stiffness of the shaver head 3, for example.

Figure 5:
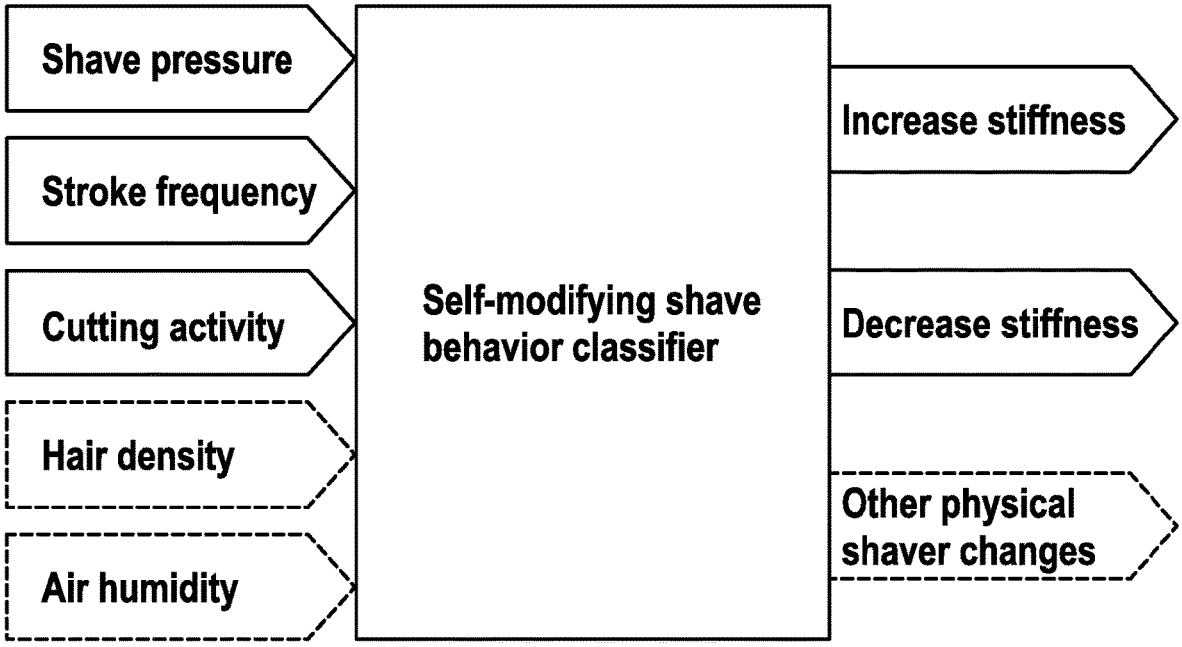
FIG. 5: a schematic diagram showing the detected parameters and the shaver's working parameters adjusted in response thereto.

So as to have the full range of settings and/or adjustments for different users having different habits, a calibration device 60 may calibrate the relation between the pivoting stiffness and the detected force, as it is illustrated by FIG. 5. Otherwise a user applying always a rather high force just would get high pivoting stiffness, whereas another user usually applying only a slight force would get only low pivoting stiffness. To avoid such undesired situation, the calibration device 60 may take into account the user history of the detected force values. More particularly, an adaptive controller 61 may vary the algorithm in terms of, for example, a curve representing the relation between the pivoting stiffness t and the amount of force. For example, when the user history shows a rather high average force, the adaptive controller 61 may change a basic curve to a curve setting stiffness high only for higher force values. On the other hand, if user history shows a rather low average force, the curve may be varied to provide for higher stiffness already for lower forces.

In addition to detection of the aforementioned force, or in the alternative to such force detection, various other behavioral and/or environmental and/or physiological parameters may be detected, wherein the aforementioned calibration device 60 may provide for calibration of the control functions of such other treatment parameters in an analogous way.

More particularly, the following detectors may be provided:

- a touch detector 42 for detecting contact of the working head 3 with the body surface 30,
- a velocity and/or acceleration detector 43 for detecting velocity and/or acceleration of the personal care device,
- a rotation detector 44 for detecting rotation and/or orientation of the personal care device in three, two or one dimensions,
- a stroke speed and/or stroke length detector 48 for detecting a stroke speed and/or stroke length, wherein such stroke detector 48 may include an accelerometer,
- a stroke density detector 49 for detecting the number of strokes over a predetermined area of the body portion to be treated, wherein such stroke density detector 49 also may include an accelerometer,
- a distance detector 50 for detecting the distance of the shaver 1 and/or the user from a mirror, wherein such distance detector 50 may include a position sensor,
- a detector 51 for detecting pauses in shaving, wherein such detector 51 may include a contact sensor detecting shaver to skin contact or an ON-OFF switch,
- an angle sensor 52 for detecting a change in angle of the shaver head 3 to a user's face and/or a change in angle of the shaver handle 2 to a user's face and/or a change in angle of a shaver handle 2 to a user's hand or arm,
- a grip detector 53 for detecting a change in the type of grip such as moving the fingers higher up the shaver body and/or holding the handle 2 with a thumb on the frontside and the other fingers on the backside etcetera,
- a contact detector 54 for detecting a contact area between the shaver head 3 and the user's face and/or a change in said contact area, for example contact with only one cutter unit 4 and/or both cutter units 4,
- a hair detector 55 for detecting hair density and/or hair length,
- an environmental detector 56 for detecting air humidity and/or air temperature,
- a displacement detector 45 for detecting linear and/or rotatory displacement of the working head 3 relative to the handle 2,
- a cutting activity detector 46 for detecting cutting activity of the personal care device,
- a trimmer position detector 47 for detecting a position of a long hair and/or medium hair trimmer.

According to an alternative embodiment, at least some of the above parameter are preferably detected as absolute rather than relative parameters. This applies in particular to the detection of the velocity, acceleration or stroke related parameters as stroke speed. The shaver 1 further may be provided with a detecting unit for detecting or measuring other parameters relevant to the treatment, wherein such detecting unit may include a voltage and/or current detector for detecting power consumption of the drive unit during shaving and/or a time measurement means for measuring shaving time, for example.

Said control unit 80 may include a micro controller 21 which may receive signals indicative of the aforementioned parameters and may analyze such signals to determine the treatment parameters mentioned above, wherein the adjustment device 6 may be controlled by the micro controller 21 to adjust any of the mentioned working parameters.

Figure 2:
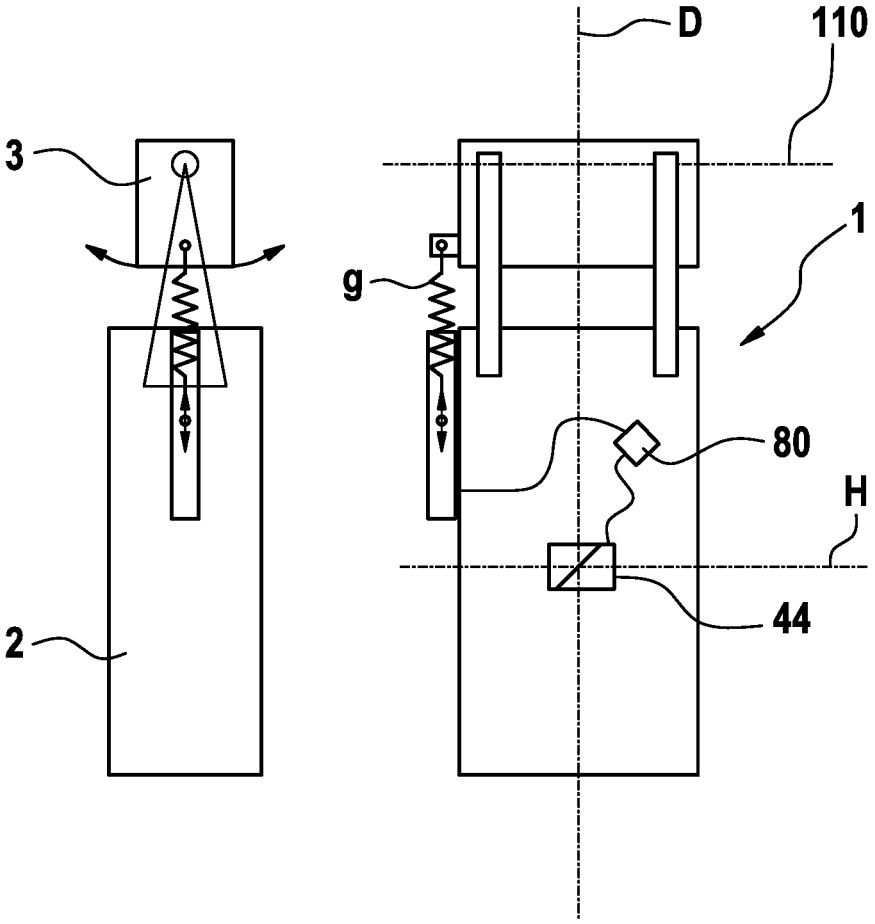
FIG. 2: a schematic front and side adjustment mechanism for adjusting views of the shaver head's pivoting stiffness.

On the basis of the detected parameters, the device may be adjusted in different ways, wherein several examples comprise the following:

A dry electric shaver cuts the beard hairs best when shaving against the grain. Users typically know this, however they find it difficult to do so in the neck area and in particular flat lying hairs on the neck and make shaving here even more difficult. In response, when shaving the neck area, a user will typically rotate his shaver 1 around it's longitudinal axis (D) and change his grip such that the shavers front side points away from him Additionally, the user then rotates the shaver around an axis (H) that is parallel to the swivel axis, as shown by FIG. 2. This is done automatically by the user, he typically will not notice that he is doing this. However, it is unergonomic and requires extra effort. The reason he intuitively moves the shaver 1 in this way is that for this situation a light swiveling head i.e. a low pivoting resistance is counterproductive. By behaving in this way, the user is able to reduce the swivel/pivoting movement.

Firstly, the shaver 1 recognizes this typically adapting behavior by means of comparing current sensor data with historical data thereof. For example, the shaver compares the current values of these measured behavioral parameters with average/typical values during previous shaves and identifies that these values are markedly different. This can be achieved by multiple different combinations of different sensors. In this embodiment, the use of an accelerometer and a gyroscope may be advantageous. The use of optical sensors, such as cameras, would be an alternative. Secondly, this may optionally further be supported by the use of physiological and/or climatic data.

Based on usage and optionally physiological and/or climatic data from a high number of users and optionally the use of machine learning, the calibration device knows which typical data from the accelerometer and gyroscope and/or this type of deviance from typical past behaviors of this user indicate this behavior. Then, when this particular different-from-typical behavior is identified, a servo-motor increases the preload of the spring (G) that connects head 3 and handle 2 to increase the stiffness of the shaver neck i.e. pivoting stiffness of the head 3 and reduce swiveling of the shaver head 3.

More particularly, the shaver head 3 which is movable relative to the shaver handle 2 with at least one degree of freedom e.g. in terms of rotation of shaver head 3 with respect to a rotation axis (herein called swivel axis (C)) that oriented orthogonally to the shaver handle's longitudinal axis (D)), wherein the shaver handle 2 is equipped with an accelerometer sensor (E) and a gyroscope. The accelerometer (E) is set up in a way to determine the spatial orientation and movement of the shaver 1 in relation to the surrounding gravitational field. The gyroscope is set up to determine twisting of the shaver 1 about its longitudinal axis. The relative movement of shaver head 3 to the handle 2 is controlled by an actuator (F), in this case a servomotor, which is set up to adjust the preload of a spring (G) that connects the shaver handle 2 to the shaver head 3. In addition, a camera system may also be included that identifies the location of flat lying hairs.

The extent to which the users rotate the shaver 1 about both axes and the speed at which they do this varies greatly, not only between different users but as well between different shaves or even during a shave. Therefore, an automatic self-modifying algorithm may be provided within the control unit (I) that controls the preload adjustment of the spring (G) based on continuous monitoring of the accelerometer data, calculating sliding average and sliding spread values on different timescales (=with variable probing times). In this way, the shaver reacts individually to the users shaving behavior to achieve a smother, more effortless shave.

According to another embodiment, findings such as numerical data from consumer research (e.g. pressing the shaver harder on the face than normal for an individual user suggests that he is adapting his behavior) may be taken into account for adjusting the shaver. For example, the shaver 1 may collect shave data from a particular user, so learns what his typical behavior is (e.g. each man naturally presses the shaver with his own individual pressure against the skin) and can identify when his behavior varies from this.

The shaver head 3 may be mounted so that it can swivel and/or tilt relative to the handle 2. A flexible shaving head 3 gives freedom how to hold the device, while enabling good adaptation to different face regions. The shaving head 3 can follow the different contours of checks, neck and jawline. This also ensures that for as much of the time as possible the complete cutting element area is in contact with the skin independent of the angle at which the user holds the shaver (within a certain range). This ensures maximum cutting area contact with the face brings the advantages of better efficiency (a quicker shave) and better skin comfort as the pressing force is spread over a larger area leading to lower pressure on the skin.

However, it has been identified that for certain shave behaviors and/or at certain moments in the shave, a low pivoting stiffness can be disadvantageous. Two examples are listed below:

1. a feeling of a loss of control can arise when a user presses his shaver with particularly high pressure against his face and the head swivels away suddenly;
2. not easy to apply targeted high pressure to a single foil (e.g. some users do this to increase the pressure at the end of the shave for increased closeness). A light swivel typically results in the head rotating so that all cutting elements touch the face.

A typical reaction to these situations is that users will adapt how they hold the shaver 1 in their hand. They change the angle of their hand and the shaver 1 so that the shaver handle 2 lies at an extreme angle such that the head 3 cannot swivel any further. However this is unergonomic and extra effort.

The current solution typically offered for these issues is a manual lock for the shaving head which can be activated. The consumer can decide between the flexible and the locked settings, however this can be inconvenient, is an extra step (again more effort) and consumers often try other alternatives (e.g. holding the head with their fingers).

According to another aspect, there may be automatically adapting the force that resists the swivel movement based on behavioral detection (e.g. detects shaving pressure, detects direction and speed of movements, detects angle of shaver handle, detects which cutting elements have contact to the skin). The algorithm that controls the swivel stiffness may modify itself based on the typical behavior of this particular user that it detects over time.

Figure 3:
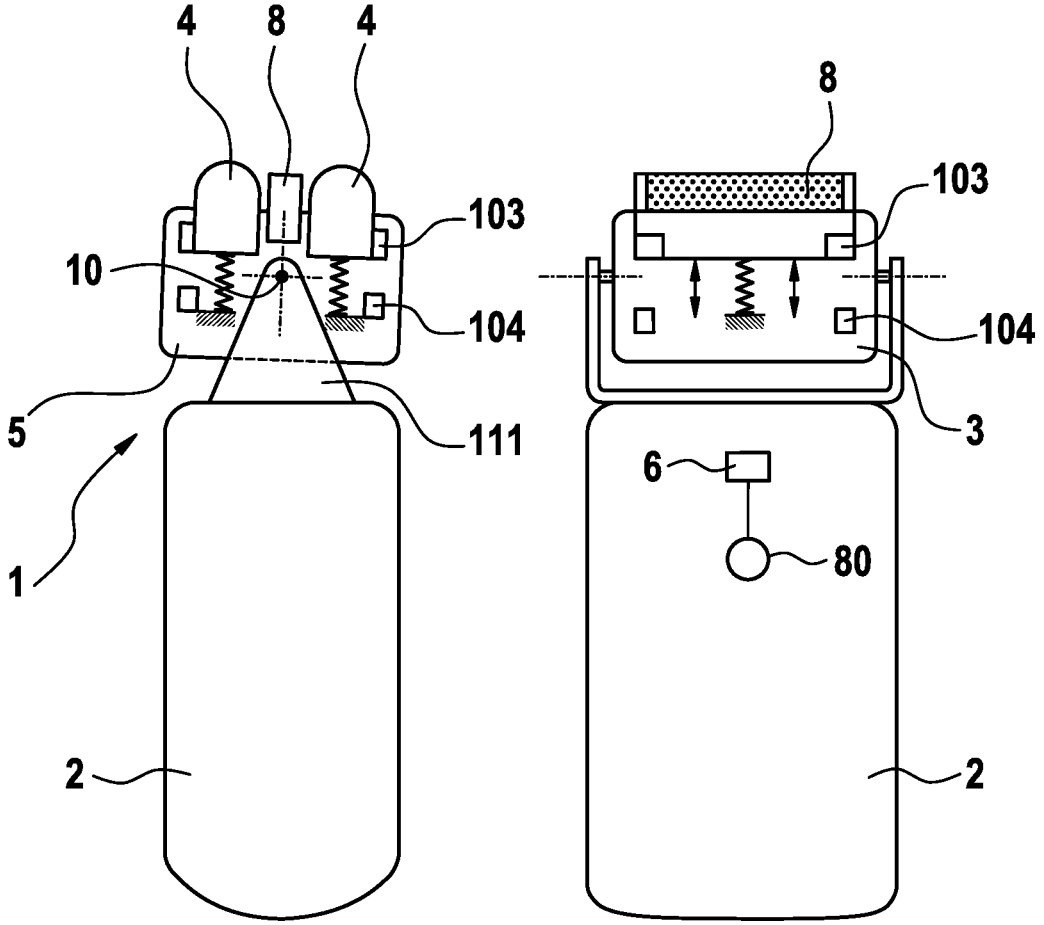
FIG. 3: schematic front and side views of a shaver similar to FIG. 2 with a detector for detecting diving of the cutter elements to determine shaving pressure according to a further embodiment.
Figure 4:
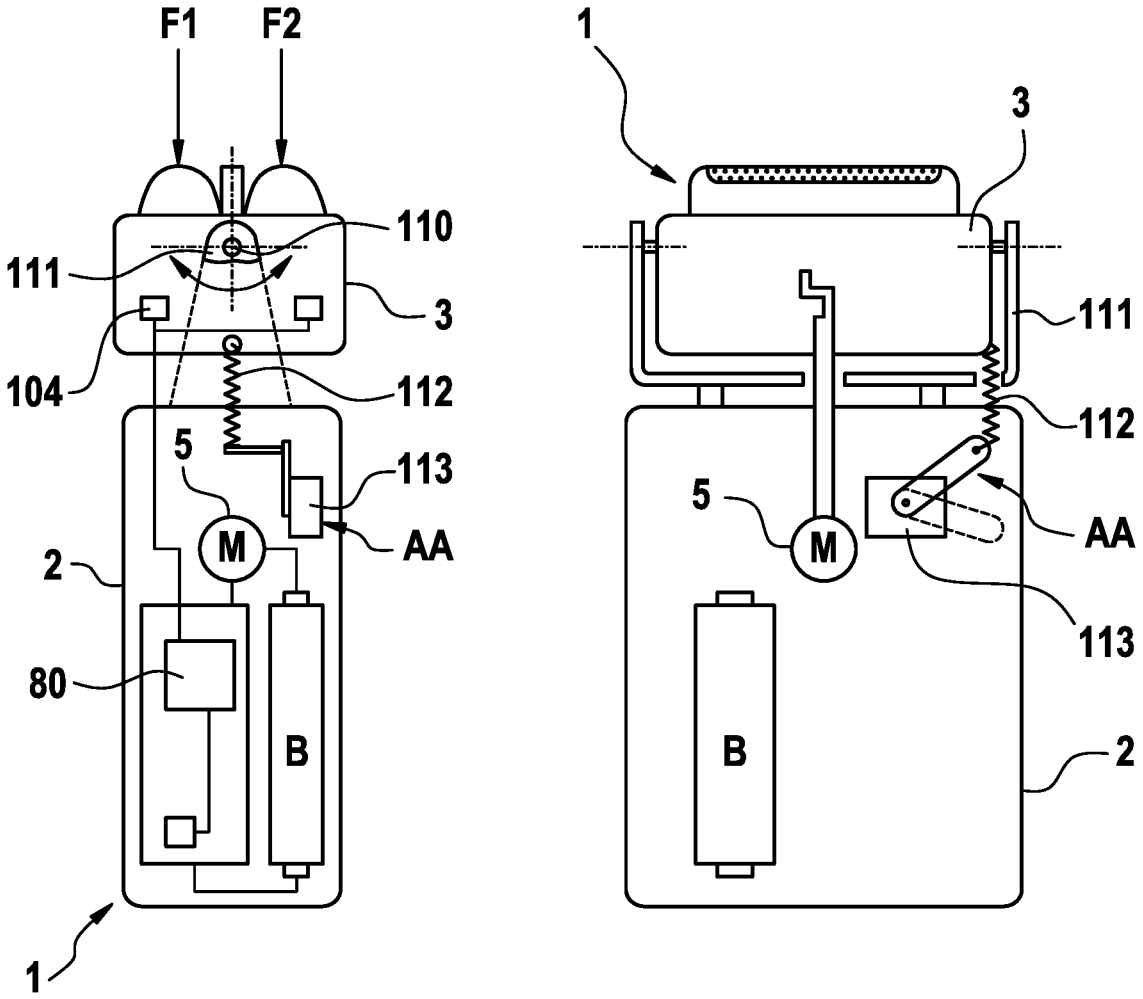
FIG. 4: schematic front and side views of a shaver similar to FIGS. 2 and 3 having the adjustment mechanism for adjusting pivoting stiffness and the adjustment mechanism for adjusting diving or floating resistance according to a further embodiment.

More particularly, the shaver 1 with a swivel head 3 is equipped with pressure sensor 41 and a sensor 43 that detects directions and speed of motion. One or more cutting elements 4 are spring loaded and carry small magnets 103, cf. FIG. 3. The higher the shaving pressure, the more the cutting elements 4 are pressed down. This movement is tracked via hall sensors 104 under each cutting element. The hall sensors are connected to the electronic control unit 80 on the internal PCB of the shaver. Mounted on the PCB may be an accelerometer to detect acceleration of all three, two or one axes of the device.

The electronic control unit 80 receives the signals of the hall sensors 104 and the accelerometer. A mathematic function translates the signals into pressure and movement data. E.g. the consumer starts to apply higher shaving pressure than typical the cutting elements 4 are moving deeper into the shaving head 3. Or the movements are faster and shorter. The electronic control unit 80 receives these untypical signals from the hall sensors 104 and the accelerometer and translates it to untypical pressure and movement values. These values are compared with a given matrix of values in real time within the control unit 80 and evaluated to generate the assigned signal for the actuator 113. In this example the spring 112 will be pulled to set a specific stiffness of the swing head 3.

Based on previous usage (e.g. other phases in the same shave and/or previous shaves), the algorithm adjusts the e.g. pressure ranges that are considered to be "low", "medium" or "high. E.g. for a man who typically shaves with a pressure of 1-2 N, the shaver would learn to consider 2N to be a high pressure for this user, whereas for a man who typically shaves with a pressure of 3-5 N, the shaver would learn to consider 2N to be low pressure for this user.

The self-modifying phase of the algorithm starts with the beginning of the first shave: The electronic of the shaver creates medium values. The more shaves are done, the accurate are the stored typical range.

The shaver body may contain a drive motor 5 and a battery 109. The swing head 3 is mounted on an axis 110 which is mounted on a holder 2 of the shaver body. When asymmetric shaving pressure is applied to the shaving system—means more pressure F1 on one of the both foils than F2 on the other—a torque occurs and the shaving head swings around its axis (10) to align on facial contours. The counterforce of the swinging head is minimized to ensure a good adaptation of the shaving system even when low pressure is applied. A pulling spring 112 is mounted between the lower end of the head and the shaver body. The spring sets the force to swing the head. The stronger the spring is set the harder the head can swing. An actuator 113 is attached to the shaver body and holds the end of the spring. It can set the pre-load of the spring 112 by changing the length of the spring. In neutral actuator position the spring has the lowest pre-load and the swing head can swing very easy. At max. actuation the spring is pulled tight and the shaving head needs more shaving pressure to get moved. The consumer feels a more stiff and rigid system. The actuator can set the spring load step-less between min. and max. actuation position.

According to a still further embodiment, the user may be requested to enter data directly e.g. via a smart phone or another device or directly into the shaver in order to provide the algorithm with additional data. This may be a onetime input e.g. after purchase or be requested on a regular basis wherein such input may be affected, for example, by voice and voice recognition. This input can then be used to assess, e.g.:

- what is of particular importance to this individual user (e.g. some men focus on closeness, whereas for others the top priority is no redness of skin)
- what problems the user currently has (e.g. missed individual longer hairs)
- details of his physiology that are relevant to shaving, e.g. does his have a particularly dense or sparse beard, does he have sensitive skin, etc.
- how he tries to solve his problems
- what sort of climatic conditions might be affecting his shave, e.g. does he typically shave before or after a shower?

Alternatively, the user may be requested to provide feedback about his shave over time. In this way, the algorithm can assess which of the modifications it made to the shaver were successful and further optimize how it reacts.

The data from multiple users can then optionally be collected and used to further refine the algorithm.

Optionally, feedback and/or instructions may also be given to the user. E.g.: when trying to shave single remaining hairs, try using less pressure (users typically apply more pressure in such situations, which is counterproductive)

In another specific example, the algorithm defining the adjustment of the shaver, as described in the previous example, may be a self-modifying classifier (e.g. a neural network). In this case, the outputs of the sensors (e.g. shave pressure, stroke frequency, cutting activity), optionally in combination with further parameters like physiological information from sensors/data entry (e.g. hair density) and/or climate data from sensors (e.g. air humidity), are linked to the input nodes of one or more shaving behavior classifiers. In the subsequent (hidden) layers of the classifier, the signals are processed and combined by a number of differentiating nodes and compared to historical data of the signals. Finally, the classifier decides if the current shaving behavior, optionally combined with further parameters named above in this paragraph, requires increasing or decreasing of the shaver head retention spring preload and thus a firmer or less firm feel of the shaving system on the skin.

To initially define the classifier, it is trained using labelled shave behavior data of a large number of test shaves in advance (factory level) wherein both real time and historical data may be used. The system then is able to adjust itself more detailed to the user by learning his specific user behavior and optionally further parameters (user-at-home level) and his reactions to the adjustments made by the system and/or by updating the classifier with a further trained version from a web-based source (cloud level). For the latter, data of many different users and shaves is collected to enlarge the training dataset. Training in this context means that the links between differentiation nodes are adjusted, weighted or added/deleted systematically and automatically in order to improve the classifier performance.

According to a further aspect, high air humidity leads to sticky skin which means that the frictional forces between skin and shaving foils/trimmers are increased. This leads to a phenomenon called "stick-slip-effect" where the shaver alternately slips easy over the skin or sticks to the skin. This makes shaving more difficult and uncomfortable. Users react in a variety of ways to this, typically they may adapt their behavior to the product-environment situation by reducing the shaving pressure they use. As however a general reduction in shaving pressure can have multiple causes, in this situation an additional air humidity sensor and in particular the change in this parameter compared to historical values of this parameter could be used in order that the algorithm can identify the appropriate shaver adjustment for this specific situation, such as increasing the stiffness of the shaver neck (spring pre-load) to reduce the uncontrolled swiveling of the head caused by the stick-slip.

When shaving a longer beard (e.g. 4 days growth and more), a user will typically adapt his behavior to the product-physiological (longer beard hairs) situation in that he moves the shaver slower than normal. A typical reason for this is that if the user is not careful, the longer hairs can get caught in the foils and tug, which is painful. This slowing down requires concentration (extra effort) and more time. Automatically raising the trimmers in the shaver head so that the beard hairs now just enter the trimmers and no longer the foils can enable to the user to move the shaver at the normal speed, even with longer beard hairs. However, as this is a fairly dramatic change to the shaver, it may be advisable to have a second sensor type (e.g. optical sensor such as a camera that detects hair length) to ensure this is the reason for the change of behavior. Time since last usage is not considered sufficient information as many men use wet razors in addition to electric dry shavers.

What is claimed is:

1. An electric shaver as a personal care device, comprising:

- an elongated handle for manually moving the personal care device along a body surface,
- a working head attached to said handle for effecting a personal care treatment to said body surface,
- a pivotable suspension associated with the working head to allow for pivoting of the working head relative to the handle about at least one axis, at least one first detector for detecting at least one behavioral parameter indicative of a user's behavior during handling the personal care device when effecting the personal care treatment, at least one second detector for detecting at least another parameter, an adjustment device configured for adjusting at least one working parameter of the personal care device in response to the at least one detected behavioral parameter, wherein the adjustment device adjusts the at least one working parameter by changing a mechanical setting or a mechanical function of the personal care device, and a calibration device for calibrating the adjustment device on the basis of historical data of the at least one behavioral parameter and historical data of the at least another parameter detected during a current treatment session and a previous treatment session, wherein the at least one working parameter of the personal care device comprises at least one of the following:

a pivoting stiffness of the working head, an operation of a hair cutter, a temperature of a cooling/heating device, an operation of a lubricant applicator, a position of different cutting and non-cutting elements relative to each other, a floating stiffness of working elements for effecting the personal care device, and a tilting stiffness of working elements.

2. The electric shaver according to claim 1, wherein said calibration device includes an adaptive controller for adaptively controlling the adjustment device in response to the at least one detected behavioral parameter to provide for different adjustments for different behavioral parameters within the range of the values of the detected behavioral parameters of the historical data thereof.

3. The electric shaver according to claim 1, wherein said calibration device is configured to calibrate said adjustment device continuously or repeatedly during effecting a personal care treatment by the personal care device and during operation of the adjustment device.

4. The electric shaver according to claim 1, wherein the at least one first detector or the at least one second detector comprises one of the following detectors:

a touch detector for detecting contact of the working head with a user's body, a velocity detector for detecting a velocity of the personal care device, a rotation detector for detecting an orientation of the personal care device in three dimensions, a stroke length detector for detecting a stroke length, a stroke density detector for detecting the number of strokes over a predetermined area of the body portion to be treated, a distance detector for detecting a distance of the personal care device, a detector for detecting pauses in the personal care treatment, an angle sensor for detecting a change in angle of the working head to a user's face, a grip detector for detecting a change in the type of grip such of fingers on the handle, a contact detector for detecting a change in said contact area, a hair detector for detecting hair length, an environmental detector for detecting air temperature, a displacement detector for detecting displacement of the working head relative to the handle, a cutting activity detector for detecting cutting activity of the personal care device, a trimmer position detector for detecting a position of a hair trimmer, a contact force detector for detecting a force at which the working head is pressed against a user's skin, a skin moisture sensor for sensing a moisture of the user's skin, a skin oiliness sensor for sensing an oiliness of the user's skin.

5. The electric shaver according to claim 1, wherein the at least one first detector comprises an angular orientation detector for detecting an angular orientation of a longitudinal axis of the handle relative to an angular rotation of the handle, wherein the adjustment device is configured to adjust the pivoting stiffness of the working head in response to the detected angular rotation of the handle.

6. The electric shaver according to claim 1, wherein the at least one second detector comprises an environmental detector for detecting an environmental parameter comprising:

air temperature, air humidity, skin moisture, or skin oiliness;

wherein the adjustment device is further configured to adjust the pivoting stiffness of the working head in response to the detected environmental parameter.

7. The electric shaver according to claim 1, wherein the at least one second detector comprises a hair detector for detecting a hair density or hair length on a body portion to be treated, wherein the adjustment device is further configured to adjust the pivoting stiffness of the working head in response to the hair density or hair length.

8. The electric shaver in accordance with claim 1, wherein the adjustment device includes at least one actuator for adjusting the at least one working parameter, said actuator being controlled by an electronic control unit in response to the at least one detected behavioral parameter.

9. An electric shaver comprising:

an elongated handle for manually moving the personal care device along a body surface, a working head attached to said handle for effecting a personal care treatment to said body surface, the working head supporting more than one cutter unit, wherein at least one cutter unit of the more than one cutter unit includes a reciprocating cutter element, at least one detector for detecting at least one behavioral parameter indicative of a user's behavior during handling the personal care device when effecting the personal care treatment, and an adjustment device configured for adjusting at least one working parameter of the personal care device in response to the detected at least one behavioral parameter, wherein the working head is pivotably supported relative to the handle about at least one pivot axis, wherein the at least one working parameter comprises a pivoting stiffness of the working head about said at least one pivot axis, wherein the adjustment device is configured to adjust the pivoting stiffness of the working head by varying a force necessary to pivot the working head relative to the handle, wherein the at least one detector comprises a contact force detector for detecting a force at which the working head is pressed against a user's skin, wherein the adjustment device is configured to increase the pivoting stiffness of the working head in response to a detected skin contact pressure reaches or exceeds a predetermined value.

10. The electric shaver according to claim 9, wherein the at least one detector comprises a grip detector for detecting a type of grip on the handle, wherein the adjustment device is configured to adjust the pivoting stiffness of the working head in response to the detected type of grip.

11. A method for controlling a personal care device, comprising an elongated handle for manually moving the personal care device along a body surface and a working head attached to said handle for effecting a personal care treatment to said body surface, comprising: using at least one first detector for detecting at least one behavioral parameter indicative of a user's behavior during handling the personal care device, using at least one second detector for detecting at least another parameter, and adjusting via an adjustment device at least one working parameter of the personal care device in response to the at least one detected behavioral parameter, wherein the adjustment device adjusts the at least one working parameter by changing a mechanical setting or a mechanical function of the personal care device, characterized by calibrating the adjustment device on the basis of historical data of the at least one behavioral parameter and historical data of the at least another parameter detected during a current treatment session and a previous treatment session.

12. The electric shaver according to claim 9, wherein the force necessary to pivot the working head relative to the handle is generated by the body surface.

13. The electric shaver according to claim 9, wherein the adjustment device comprises a biasing element mounted between the working head and the handle for adjusting the pivoting stiffness of the working head.

* * * * *